United States Patent [19]

Baeck et al.

[11] Patent Number: 5,062,972

[45] Date of Patent: Nov. 5, 1991

[54] FABRIC CONDITIONING COMPOSITIONS: NATURAL HECTORITE CLAY AND BINDING AND DISPERSING AGENT

[75] Inventors: André C. Baeck, Bonheiden; Alfred Busch, Strombeek-Bever, both of Belgium; Young S. Oh, Fairfield, Ohio

[73] Assignee: The Procter & Gamble Co., Cincinnati, Ohio

[21] Appl. No.: 453,442

[22] Filed: Dec. 20, 1989

Related U.S. Application Data

[63] Continuation-in-part of Ser. No. 287,977, Dec. 21, 1988, abandoned.

[30] Foreign Application Priority Data

Jan. 3, 1989 [GB] United Kingdom ..... 8900027

[51] Int. Cl.[5] ..... D06M 11/06; D06M 13/34

[52] U.S. Cl. ..... 252/8.8; 252/8.6; 252/8.9

[58] Field of Search ..... 252/8.8, 8.9

[56] References Cited

U.S. PATENT DOCUMENTS

| | | | |
|---|---|---|---|
| 2,920,045 | 1/1960 | Hearn et al. | 252/137 |
| 3,033,699 | 5/1962 | Aarons et al. | 106/286 |
| 3,594,221 | 7/1971 | Baldwin | 117/138.5 |
| 3,915,882 | 10/1975 | Nirschl et al. | 252/131 |
| 3,959,155 | 5/1976 | Montgomery et al. | 252/8.8 |
| 3,989,631 | 11/1976 | Marsan | 252/8.6 |
| 4,062,647 | 12/1977 | Storm et al. | 8/137 |
| 4,178,254 | 12/1979 | Leikhim et al. | 252/8.6 |
| 4,199,464 | 4/1980 | Cambre | 252/8.8 |
| 4,292,035 | 9/1981 | Battrell | 8/137 |
| 4,294,710 | 10/1981 | Hardy et al. | 252/8.8 |
| 4,597,886 | 7/1986 | Goedhart et al. | 252/95 |
| 4,609,473 | 9/1986 | Ramachandran et al. | 252/8.6 |
| 4,770,815 | 9/1988 | Baker et al. | 252/542 |

FOREIGN PATENT DOCUMENTS

| | | |
|---|---|---|
| 088372 | 9/1983 | European Pat. Off. . |
| 0133804 | 3/1985 | European Pat. Off. . |

OTHER PUBLICATIONS

Rengasamy et al., *Particle Size Wyoming Bentonite . . . ,* J. Chem. Soc. Faraday Trans. I.; 72(2), 376–381; 1976.

Schott, *Uptake of Clay by Cotton,* Textile Research Journal, pp. 610–620, Jul. 1965.

"Veegum the Super Natural Ingredient", sales pamphlet, R. T. Vanderbilt Company Booklet No. 97, Sep. 1987.

*Primary Examiner*—A. Lionel Clingman

*Attorney, Agent, or Firm*—L. W. Lewis; J. J. Yetter; R. C. Witte

[57] ABSTRACT

Fabric conditioning compositions are disclosed which comprise, as a fabric softening ingredient, a fabric softening clay. The fabric softening clay is a hectorite of natural origin, and has a layer change distribution such that at least 50% is in the range 0.23–0.31. The clays exhibit high relative deposition values.

26 Claims, No Drawings

FABRIC CONDITIONING COMPOSITIONS: NATURAL HECTORITE CLAY AND BINDING AND DISPERSING AGENT

CROSS-REFERENCE TO RELATED CASE

This is a continuation-in-part of application Ser. No. 7/287,977, filed Dec. 21, 1988, now abandoned.

TECHNICAL FIELD

The present invention relates to granular fabric conditioning compositions. More specifically it relates to compositions containing a fabric-softening amount of a hectorite clay, the clay having a narrowly-defined layer charge distribution and preferably having a high level of deposition upon fabrics.

BACKGROUND

In fabric softening executions disclosed in the art, smectite clays have often been used in combination with other ingredients, such as conventional rinse-added fabric softening actives. Illustrative of this art are:

GB-A-1 519 605, disclosing fabric softening compositions containing mixtures of smectite clays and water-insoluble quaternary ammonium compounds;

U.S. Pat. No. 4,292,835 describing solid fabric softening compositions containing smectite clay complexed with an anionic surfactant, and fabric softening amines or salts thereof;

EP-A-0 004 111 describing fabric-care compositions consisting of aqueous dispersion of a smectite-clay and a gelatinized vegetable starch.

It is well recognized in the detergent industry that clays of the type disclosed above can provide significant fabric softening benefits. Yet, it is equally well recognized that deposition of these clays onto the fabrics during the laundering process is far from complete. Moreover, the softening effect obtained as a result of the clay deposition is affected by factors that are not well understood.

It has now been found that a narrowly defined class of hectorite clays, not disclosed per se in the above-referred state of the art, surprisingly provides excellent fabric-softening benefits.

It is an object of the present invention to provide granular and liquid fabric conditioning compositions that can be added to the laundry during a rinse and/or wash stage of the laundry process comprising a fabric softening clay from which the clay is more efficiently deposited onto fabrics during the laundry process. It is further object of this invention to select clay materials for use in conditioning compositions that provide a significantly better fabric-softening performance, based upon a constant amount of clay utilized, than the clay materials used to date in commercial fabric conditioning compositions.

SUMMARY OF THE INVENTION

The present invention relates to fabric conditioning compositions containing a specific hectorite clay for addition to laundry loads in the wash and/or rinse stage, and to a method of softening fabrics. In one aspect of the invention, the compositions are in granular form and comprise agglomerates of the clay and a binding/dispersing agent. In another aspect of the invention, the compositions are aqueous dispersions of the clay or are granular formulations (containing particulate or agglomerated clay) which also comprise at least one other fabric conditioning ingredient, such as an organic humectant, a clay-flocculating agent, a static control agent, or an organic softener. The clay has a narrowly defined layer charge distribution, such that at least about 50% of the clay has a layer charge of from about 0.23 to about 0.31.

DETAILED DESCRIPTION OF THE INVENTION

The clay, utilized in the present invention which is of the smectite-type, is selected on basis of its layer charge properties. The hectorite clays of natural origin, suitable for the detergent compositions of the present invention, have the 35 general formula:

$$[Mg_{3-x}Li_x)Si_{4-y}Me_y^{III}O_{10}(OH_{2-z}F_z)]^{-(x+y)}_{\frac{(x+y)}{n}}\ M^{n+}$$

wherein y=o; or, if y≠o, $Me^{III}$ is Al, Fe, or B; $M^{n+}$ is a monovalent (n=1) or divalent (n=2) metal cation, for example selected from Na, K, Mg, Ca, Sr. The value of (x+y) is the layer charge of the hectorite clay. The hectorite clays suitable for the detergent compositions of the present invention have a layer charge distribution such that at least 50% is in the range of from 0.23 to 0.31.

Preferred are hectorite clays of natural origin having a layer charge distribution such that at least 65% is in the range of from 0.23 to 0.31.

The layer charge distribution of the clay material can be determined using its swelling in the presence of cationic surfactants having specific chain lengths. This method is described in detail by Lagaly and Weiss, Zeitschrift fuer Pflanzenernaehrung und Bodenkunde, 130(1), 1971, pages 9–24, the disclosures of which are incorporated herein by reference.

As noted hereinabove, the clays employed in the compositions of the instant invention contain counter-ions, such as protons, sodium ions, potassium ions, calcium ions, magnesium ions, and the like. It is customary to distinguish between clays on the basis of one cation predominantly or exclusively absorbed. For example, a sodium clay is one in which the absorbed cation is predominantly sodium.

A calcium clay is one in which the absorbed cation is predominantly calcium.

The hectorite clays of the present invention should preferably be sodium clays, for better softening activity.

Sodium clays are either naturally occurring, or are naturally-occurring calcium-clays which have been treated so as to convert them to sodium-clays. If calcium-clays are used in the present compositions, a salt of sodium can be added to the compositions in order to convert the calcium clay to a sodium clay. Preferably, such a salt is sodium carbonate, typically added at levels of up to 5% of the total amount of clay.

The preferred hectorite clays used in the fabric conditioning compositions can be further characterized by their high level of deposition onto fabrics. Deposition of hectorite clays of the present invention from fabric conditioning compositions onto fabrics is surprisingly greater than the deposition of other naturally occurring clays. Deposition can be measured according to the Relative Deposition Measurement procedure described in the Experimental section below. The Relative Deposition of the clays of the present invention for 77 ppm treatment levels, for addition of the clay to either the wash or rinse stage of the laundry cleaning process, is preferably at least about 2.5 more preferably at least about 2.7, and most preferably at least about 2.9 as defined herein. As used herein, "Relative Deposition" shall refer to the above-referenced procedure using a 77 ppm treatment level, unless otherwise specifically indicated. The deposition of these clays appears to be proportional to the softness of the treated fabric. Examples of suitable hectorite clays include Bentone EW and Macaloid, both mined in or near Amargosa Valley, Nev., (U.S.A.) and available from NL Chemicals, N.J. Naturally occurring hectorite clays within the scope of the present invention also include IMV Hectorite, available from Industrial Mineral Ventures, Amargosa Valley, Nev. Also encompassed herein are hectorites mined in Turkey such as, but not limited to, Turkish calcium hectorite clay.

Granular Clay Agglomerate Compositions

The granular clay agglomerate fabric conditioning compositions of the present invention contain from about 0% to 100% of the fabric softening clay described below. With regard to clay agglomerate compositions intended for rinse-added application, the composition preferably contains from about 10% to about 99% of the fabric softening clay described below, and from about 0.5% to about 40% of a binding/dispersing agent. As set forth above, the clay is in the form of an agglomerate. The composition may optionally contain other fabric conditioners, perfumes, dyes or other ingredients useful for fabric conditioning or cleaning compositions. Preferably, in the case of agglomerates to be added to the rinse stage of a laundry operation, these agglomerated particles will not contain detersive ingredients, such as surfactants, builders, clay soil removers, enzymes, and the like, in sufficiently large quantities to significantly interfere with the rinsing process. Generally, the compositions for rinse-added applications will contain less than about 30%, by weight of the agglomerate, of such detersive ingredient will be present, preferably less than about 15%, more preferably less than about 10%.

The hectorite clay, thus, is provided as free-flowing agglomerates of clay. The agglomerates can comprise smaller particles of clay such as are commercially available in the industry. Typically, the particles will be from about 1 micron to about 50 microns. The clay agglomerates can also be made in the desired size range (discussed below) directly from an aqueous clay slurry by spray drying or other techniques known in the art. The agglomerates should have a median diameter of from about 75 microns to about 2000 microns, preferably a median diameter of from about 100 microns and about 1250 microns, most preferably from about 300 microns to about 1000 microns. The clay agglomerates are preferably screened so as to separate agglomerates less than about 75 microns, preferably less than about 100 microns, and greater then about 2000 microns, preferably greater than about 1250 microns.

It is an important aspect for rinse-added applications that the clay agglomerates contain, in addition to the clay, a binding/dispersing agent. It has been found that the clay, when agglomerated and added to the rinse stage of an automatic washing machine without presence of such binding/dispersing agent, does not provide well-distributed deposition of the clay upon the fabrics. Rather, the clay tends to further agglomerate at the surface of the rinse water and deposit upon the fabrics with poor distribution. It is important for obtaining even deposition that the clay agglomerates sink or otherwise remain below the surface of the rinse water during the rinse stage and, further, become well-dispersed prior to the end of the rinse stage. Typically, the rinse stage of an automatic washing machine will be between about 2 and about 5 minutes.

Agglomeration methods and equipment suitable for use include those methods known in the art. Non-limiting examples of the equipment suitable for agglomeration of clay from smaller particles include a Dravo pan agglomerator, KG/Schugi Blender-Granulator, whirling knife continuous vertical fluidized bed agglomerator, Niro Fluidized Bed agglomerator, Obrian Mixer-/Agglomerator, Loedige agglomeration and a Littleford mixer (Littleford Brothers, Inc., Florence, Ky., USA, eg. Model FM130D).

Other methods and equipment which use larger amounts of water, including the manufacture of agglomerates (as defined herein) directly from a clay slurry, include a spray drying tower, and a prilling tower.

On a laboratory scale, food processors which are widely available to the general public can be used to agglomerate smaller clay particles into agglomerates in the disclosed size ranges.

In making the clay agglomerates, an aqueous mixture of water and the binding/dispersing agent can be first prepared and slowly added to the clay while the clay is subjected to the mechanical agitation of the agglomeration equipment. Once agglomerated, the clay can be dried, but should not be over-dried. Overdrying can, as will be understood by those skilled in the clay art, lead to reduced ability of the clay to disperse. Drying at ambient temperatures unaided or aided by forced air provides acceptable drying levels.

Preferred binding/dispersing agents are water-soluble inorganic salts. These can include sodium carbonate, sodium sulfate, potassium carbonate, potassium sulfate, magnesium sulfate, lithium sulfate, lithium carbonate, sodium citrate, and sodium sesquicarbonate. Most preferred are sodium sulfate and sodium carbonate. Without limiting the invention, it is theorized that salts such as sodium carbonate which are basic in character are particularly advantageous for the present compositions. These water soluble inorganic salts are believed to act as binding agents which impart a temporary binding force that facilitates agglomerate integrity for a sufficiently long period after being added to the rinse stage of an automatic washing machine such that the agglomerates can sink or remain below the surface of the water. However, importantly, since the salts are water soluble, the binding force dissipates during the rinse stage so that the clay agglomerates can hydrate and disperse, to thereby facilitate even distribution of the clay upon the fabrics in the washing machine. Additionally, the salts are of relatively high density and inclusion of the salts into the agglomerates can aid with increasing the agglomerate density. Excessive compression of the clay to achieve the desired density can inhibit dispersion. The agglomerates preferably have a density of greater than about 1.0 g/cc. The agglomerates typically will contain from about 1% to about 40%, preferably from about 5% to about 35%, more preferably from about 10% to about 35% of water insoluble inorganic salt, based upon the total weight of the agglomerate.

Another type of binding/dispersing agent that can be used, alone or in combination with a water insoluble inorganic salt, is specifically referred to as a "dispersing aid." Dispersing aids that can be used can generally include surfactants. These include surfactants commonly use as detersives in laundry detergents (though they will be present in substantially lower concentrations when added to the rinse stage as part of the present compositions). The surfactants suitable for use can comprise an anionic, nonionic, ampholytic or zwitterionic surfactant or a mixture thereof. Nonionic surfactants, or other surfactants, that can interfere with clay deposition should be used in low amounts only, preferably less than about 10% of the weight of the agglomerate, as previously discussed. Anionic surfactants are preferred. Typical anionic surfactants are the alkyl benzene sulfonates, alkyl- and alkylether sulfates, paraffin sulfonates, olefin sulfonates, alkoxylated (especially ethoxylated) alcohols and phenols, amine oxides, alpha-sulfonates of fatty acids and of fatty acid esters, and the like, which are well-known from the detergency art. In general, such surfactants contain an alkyl group in the $C_8$–$C_{26}$ range, more generally in the $C_8$–$C_{18}$ range. The anionic surfactants can be used in the form of their sodium, potassium or triethanolammonium salts: Anionic phosphate surfactants are also useful in the present invention. These are surface active materials in which the anionic solubilizing group connecting hydrophobic moieties is an oxy acid of phosphorus. The more common solubilizing groups, of course are —$SO_4H$ and —$SO_3H$. Alkyl phosphate esters such as $(R—O)_2PO_2H$ and $ROPO_3H_2$ in which R represents an alkyl chain containing from about 8 to about 20 carbon atoms are useful herein. Suitable nonionic surfactants useful in the present invention include those obtained by the condensation of one to twelve ethylene oxide moieties with a $C_{10}$–$C_{18}$ aliphatic alcohol. The alcohol may be completely linear as occurs in materials derived from the natural feedstocks such as vegetable oils and animal fats, or may be slightly branched as occurs in petroleum derived alcohols made by oxo-type synthesis. Other nonionic materials are $C_{14}$–$C_{15}$ alcohol condensed with an average of seven ethylene oxide groups. $C_{12-C13}$ alcohol condensed with an average of about four ethylene oxide groups and then subjected to stripping to remove unethoxylated and low ethoxylated materials, to leave an ethoxylated having a mean of 4.5 ethylene oxide groups. Suitable zwitterionic materials include derivatives of quaternary ammonium compounds containing an aliphatic straight chain group of 14–18 carbon atoms and a sulfate or sulfonate anionic solubilizing group. Specific examples include 3-N, N-dimethyl-N-hexadecylammonio-2-hydroxpropane-1-sulfonates; 3-(N,N-dimethyl-N-tallowylammonio)-2-hydroxypropane-1-sulfonate; 3-(N,N-dimethyl-N-tetradecyl ammonio)-propane-1sulfonate; and 6-(N,N-dimethyl-N-hexadecylammonion)-hexanoate.

When the clay agglomerates are made from clay slurry, the binding/dispersing agent can be added and mixed with the slurry prior to formation of the clay into relatively small particles by, for example, prilling or spray drying. These particles can then be agglomerated into the agglomerate range defined above. Alternately, agglomerates encompassed by said size range can be formed directly from the slurry by the same general processing methods. In the former case, the particles are preferably agglomerated with the use of an aqueous solution which contains more of a binding/dispersing agent.

The hectorite clays of the present invention can additionally be utilized in a non-agglomerated, or "particulate," form, as a powder or simple mixture of clay particles typically from about 1 to about 50 microns in diameter.

Such particulate compositions according to the present invention typically contain from about 15% to 100%, preferably from about 50% to about 95%, by weight, of the hectorite clay.

Aqueous dispersions for use according to the present invention comprise from about 0.5% to about 30%, preferably from about 2% to about 15%, by weight, of the hectorite clay, and water.

In the preparation of the granular and liquid fabric conditioning compositions hereof, it may be desirable and appropriate to use certain additive ingredients, which are described in detail hereinbelow, especially a clay flocculating agent, a humectant, a static control agent, or an organic softener.

Additive Ingredients

Clay flocculating agent

Clay-flocculating agents are very well known in industries like oil well drilling, and for ore flotation in metallurgy. Most of these materials are fairly long chain polymers and copolymers derived from such monomers as ethylene oxide, acrylamide, acrylic acid, dimethylamino ethyl metacrylate, vinyl alcohol, vinyl pyrrolidone, ethylene imine. Gums, like guar gum, are suitable as well.

Preferred are poly(ethylene oxide), poly(acrylamide), and poly(acrylic acid). It has been found that these polymers enhance the deposition of a fabric softening clay if their weights (weight average) are in the range of from 100,000 to 10 million. Preferred are such polymers having (weight average) molecular weight of from 150,000 to 5 million.

The most preferred polymer is poly (ethylene oxide). Molecular weight distributions can be readily determined using gel permeation chromatography, against standards of poly (ethylene oxide) of narrow molecular weight distributions.

The compositions herein may comprise, from 0.05% to 20%, by weight of the clay, of clay flocculating agent, if its molecular weight is 150,00–180,000 and from 0.005% to 2%, by weight of the clay, if its molecular weight is from 800,000 to 5 million.

Clay-flocculating agents can be used in both aqueous dispersion and granular (agglomerate or particulate) forms of the present compositions.

Aqueous Dispersion Aid

Agents suitable as aqueous dispersion aids, in both aqueous dispersions herein, include surfactants described above in connection with agglomerate binding dispersing agents. More particularly, the aqueous dispersion aid can be advantageously selected from polycarboxylates of relatively low molecular weight (as compared to above clay-flocculating polymers). Such polycarboxylates can be copolymers of an unsaturated polycarboxylic acid such as maleic acid, as first monomer, and an unsaturated monocarboxylic acid such as acrylic acid as second monomer. Preferably, still, the polycarboxylates herein are homopolymers, having a molecular weight in the range of from 1000 to 10,000, most preferably polyacrylates. Such polycarboxylate dispersing aids may be used at levels of from 10% to 100%, preferably 20% to 50% by weight of the clay, in an aqueous dispersion execution, or from 5% to 50% by weight of the total composition in a particulate composition execution.

Other agents which can be used as dispersing aids include electrolytes such as water-soluble phosphates, polyphosphates, acid and neutral pyrophosphates, carbonates, sulphates, chlorides, borates, silicates, and mixtures thereof.

Stabilizing Agent

If clay-flocculating agents are used in the present compositions, the presence of a stabilizing agent will be desirable. Such a stabilizing agent can be selected from conventional metal sequestering and chelating agents, well known used in the detergency art. Preferred for use herein are chelating agents, such as amino phosphonic acids and salts thereof.

Preferred are ethylene diamine tetramethylenephosphonic acid, hexamethylene diaminetetramethylene phosphonic acid, diethylene triaminepentamethylene phosphonic acid, amino-trimethylene phosphonic acid, and salts thereof.

Above stabilizing agent can be used at levels of from 0.1% to 5% by weight of the clay. Stabilizing agents are generally to be used in the aqueous dispersion form of the present invention.

Organic Humectant

An organic humectant may also be used in the compositions of the present invention.

Organic humectants may be any of the various water soluble materials utilized for such a purpose. The organic humectants are preferably selected from the group consisting of a) aliphatic hydrocarbon polyols having from 2 to 9 carbon atoms; b) ether alcohols derived from the polyols of a); c) ester alcohols derived from the polyols of a); d) mono- and oligosaccharides; and mixtures thereof.

Highly preferred humectants include glycerol, ethylene glycol, propylene glycol and the dimers and trimers of glycerol, of ethylene glycol and of propylene glycol.

The compositions herein may comprise humectant levels from 0.5% to 30%, preferably from 2% to 15%, by weight of the clay. Humectants are useful in the aqueous dispersion form of the present invention.

The compositions herein can contain, in addition to ingredients already mentioned, various other optional ingredients typically used in commercial products to provide aesthetic or additional product performance benefits. Typical ingredients include pH regulants, perfumes, dyes, bleach, optical brighteners, soil suspending agents, hydrotropes and gel-control agents, freeze-thaw stabilizers, bactericides, preservatives, carriers for such optional ingredients, and the like.

Optional Softening Ingredients

The fabric conditioning compositions of the present invention may further contain, in addition to the clay material, other fabric softening ingredients. Organic and inorganic materials can be included either as part of the hectorite-containing agglomerates, as separate particles or agglomerates admixed optional with the hectorite-containing agglomerates or smaller clay particles, or as part of aqueous dispersions of the hectorite clay. The compositions of the present invention preferably do not, however, contain substantial amounts of other clay softener materials, since such other clays known in the art generally do not provide as effective softening benefits as the claimed hectorites. Clays, in general, particularly naturally-occurring clays, generally contain impurities. This is true even with respect to most grades of processed clay. Included among the impurities that may be present in hectorite clays of this invention are species of hectorite clays not with the scope of the present invention and non-hectorite clays. Preferably, the clay ingredient used in the present invention consists essentially of the contemplated hectorite clays. "Consists essentially of" as used herein, requires that the clay material used contains no more than about 10%, more preferably no more than about 5%, of other clays, most preferably no more than about 1% of other clays.

Suitable examples, optional of softening ingredients, include amines of the formula $R_1R_2R_3N$, wherein $R_1$ is $C_6$ to $C_{20}$ hydrocarbyl, $R_2$ is $C_1$ to $C_{20}$ hydrocarbyl, and $R_3$ is $C_1$ to $C_{10}$ hydrocarbyl or hydrogen. A preferred amine of this type is ditallowmethylamine.

Preferably, the amine is present as a complex with a fatty acid of the formula RCOOH, wherein R is a $C_9$ to $C_{20}$ alkyl or alkenyl. It is desirable that the amine/fatty acid complex be present in the form of microfine particles, having a particle size in the range of from e.g., 0.1 to 20 micrometers. These amine/fatty acid complexes are disclosed more fully in European Patent Application No. 0 133 804, the disclosures of which are incorporated herein by reference. Preferred are compositions that contain from 1% to 10% of the amine.

Suitable are also complexes of the above described amine and phosphate esters of the formula

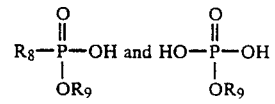

wherein $R_8$ and $R_9$ are $C_1$–$C_{20}$ alkyl, or ethoxylated alkyl groups of the general formula alkyl-$(OCH_2CH_2)_y$, wherein the alkyl substituent is $C_1$–$C_{20}$, preferably $C_8$–$C_{16}$, and y is an integer of 1 to 15, preferably 2–10, most preferably 2–5. Amine/phosphate ester complexes of this type are more fully disclosed in European Patent Application No. 0 168 889, the disclosures of which are incorporated herein by reference.

Further examples of optional softening ingredients include the amides of the formula $R_{10}R_{11}NCOR_{12}$, wherein $R_{10}$ and $R_{11}$ are independently selected from $C_1$–$C_{22}$ alkyl, alkenyl, hydroxyl alkyl, aryl, and alkyl-aryl groups; $R_{12}$ is hydrogen, or a $C_1$–$C_{22}$ alkyl or alkenyl, an aryl or alkyl-aryl group. Preferred examples of these amides are ditallow acetamide and ditallow benzamide. Good results are obtained when the amides are present in the composition in the form of a composite with a fatty acid or with a phosphate ester, as described hereinbefore for the softening amines.

The amides are typically present in the compositions at 1%–10% by weight.

Suitable conditioning ingredients are also the amines disclosed in U.K. Patent Application GB 2 173 827, the disclosures of which are incorporated herein by reference, in particular the substituted cyclic amines disclosed therein. Suitable are imidazolines of the general formula 1-(higher alkyl) amido (lower alkyl)-2-(higher alkyl) imidazoline wherein higher alkyl is alkyl having from 12 to 22 carbon atoms, and lower alkyl is alkyl having from 1 to 4 carbon atoms. Softener materials of this type are preferably added to the composition as particles or agglomerates as disclosed in U.S. patent application Ser. No. 922 912, filed Oct. 24, 1986 by Baker et al, the disclosures of which are incorporated herein by reference.

Other suitable conditioning ingredients include quaternary ammonium compounds, such as ditallowdimethylammonium chloride, and similar compounds where at least one of the tallow chain is interrupted by an ester linkage such as described in EP-A-293 952. Also useful as co-softening agents are also the amines disclosed in EPA-A-199 383, in particular the substituted cyclic amines disclosed therein. Suitable are imidazolines of the general formula 1-(higher alkyl) amido (lower alkyl)-2-(higher alkyl)imidazoline wherein higher alkyl is alkyl having from 12 to 22 carbon atoms. A preferred cyclic amine is 1-tallowamidoethyl-2-tallowimidazoline.

A preferred cyclic amine is 1-tallowamidoethyl-2-tallow imidazoline. Preferred compositions contain from about 1% to about 10% of the substituted cyclic amine.

Static Control Agents

It may also be desirable to include a conditioning agent which controls static in the dryer. Suitable static control agents include ion-pair complexes of the formula $(R_1R_2R_3N^+H)$ $(A^-)$ wherein $R_1$ and $R_2$ are $C_{12}$–$C_{20}$ alkyl or alkenyl, $R_3$ is H or $CH_3$ and $A^-$ is an anion, such as benzene sulfonate a $C_1$–$C_{18}$, preferably $C_1$–$C_5$, more preferably $C_1$–$C_3$, linear alkyl benzene sulfonate. These anti-static agents can also provide a softening benefit. These and other suitable anti-static agents are disclosed in U.S. Ser. No. 153,173, D. S. Caswell, filed Feb. 8, 1988, and U.S. Pat. No. 3,959,155, R. E. Montgomery, et al., issued May 25, 1976, both incorporated herein by reference.

To avoid negative interactions with the clay materials, above organic conditioning agents, when appropriate, can be (releasably) encapsulated by suitable materials which, while ensuring the proper release of the organic material in the rinse water, remain stable and avoid negative interactions, upon storage of the products.

The fabric conditioning compositions are typically used at a concentration to provide at least about 50 ppm of the clay in the aqueous laundry solution (exclusive of any fabrics). Addition to the wash and rinse stages are contemplated. Preferably, when the compositions are added in the rinse cycle of a washing machine, at least about 100 ppm and less than about 200 ppm, more preferably between about 100 ppm and about 150 ppm, of clay is used based upon the weight of the laundry solution. When used at concentration of 150 ppm, the compositions encompassed by the present invention will typically have a Relative Deposition (wash added or rinse added applications), as measured by the test described in the Experimental, of at least about 13.0 in an aqueous laundry bath at pH 7–11. The fabric conditioning can be carried out over the range from about 5° C. to the boil.

When added during the wash stage of a washing machine, preferably between about 50 ppm and about 250 ppm, more preferably between about 75 ppm and about 150 ppm are added, based upon the weight of the laundry solution.

Typically, no more than about 0.1 kg fabric (dry base) per liter of water are treated. Generally, from about 0.05 to about 0.08 kg fabric/liter water are treated.

Recently, a method has developed for objective assessment of fabric softeners. The method consists of a battery of tests, known in the detergent industry as the KES-F system of Kawabata. The method is described in S. Kawabata, "The Standardization and Analysis of Hand Evaluation", 2nd Ed., Textile Mach. Soc. of Japan, Osaka, 1980, the disclosures of which are incorporated herein by reference. The shear hysteresis parameter 2HG5 of the KES-F system is believed to be particularly useful in the characterization of fabric softening clays. Preferred herein are hectorite clays which, when incorporated in fabric conditioning compositions at 10% by weight, reduce the shear hysteresis of fabrics laundered therein by at least 32%, more preferable by at least 35%. The shear hysteresis parameter 2HG5 is discussed in more detail in Finnimore and Koenig, Melliand Textilberichte 67 (1986) pages 514–516, the disclosures of which are incorporated herein by reference.

Softness measurements can also be obtained from expert panelists' subjective assessment of softness relative to a control.

EXPERIMENTAL

Relative Deposition Measurement

A. Washing procedure

Prewash: Cotton/Polyester (86%/14%) terry cloths (Style 4025, Dundee Mills, Griffin, Ga.) that are 11×11 square inches (27.9×7.9 square cm) and weigh about 50 g each are used for the Relative Deposition test. The cloths are washed two times with a conventional non-clay containing detergent formulation (shown below) in 0 grain/gallon water at 125° F. (52° C.) for 12 minutes each, then washed two times in 0 grain/gallon water at 125° F. (52° C.) without detergent and dried in a Whirlpool 3 Cycle Portable Dryer (Model #LE4905XM, Whirlpool Corp., Benton Harbor, Mich.).

Prewash Detergent Composition:

| Ingredient | % (Wt.) |
|---|---|
| $C_{12}$ Linear Alkyl Benzene Sulfonate (Na Salt) | 4.1 |
| Tallow Alcohol Sulfate (Na Salt) | 5.0 |
| Neodol ® 23-6.5 (Alkyl Ethoxylate) | 2.0 |
| Tallow Soap | 1.9 |
| Sodium Tripolyphosphate | 32.0 |
| Silicate | 6.5 |
| Water and Miscellaneous | balance to 100 |

Test Wash: A miniwasher with five pots (such as those manufactured by Yorktown Tool & Die Corp., Yorktown, Ind.) is used. For wash-added clay softener tests, 9.12 g of detergent product (Testwash Detergent Composition, as shown below) and 0.58 g of a clay of the present invention (77ppm in the wash) are added to two gallons of 6 grain/gallon water at 95° F. (35° C.) in each mini-washer pot and agitated for two minutes. For rinse-added tests, the clay is added at the beginning of the rinse stage (after the rinse water has filled the miniwasher). Alternately, where specifically set forth herein, higher clay concentrations, eg. 150 ppm, can be utilized. This, of course, will affect results and direct comparisons between clay concentrations are not reliable. A load of fabrics weighing about 341 g and including test fabrics of four of the prewashed terry cloths, six polyester/cotton (65%/35%) 11×11 square inch (27.9×27.9 square cm) swatches (product #7435, Test Fabrics, Middlesex, N.J.) weighing a total of about 37 g, three 11×11 inch nylon swatches (product #322, Test Fabrics) weighing a total of about 18 g, three 11×11 inch polyester swatches (product #720-H, Test Fabrics) weighing a total of about 44 g, and one polyacrylic sock (Burlington Socks, Balfour Inc., Asheboro, N.C.) weighing about 42 g are added to the wash water. The fabrics are washed for 12 min. and spin dried for two minutes. The fabrics are then rinsed with two gallons of 6 grain/gallon water at 70° F. (21° C.) for two minutes, spin dried for two minutes, and dried in a Whirlpool 3 Cycle Portable (Model No. LE4905XM, Whirlpool Corp., Benton Harbor, Mich.). This test wash procedure is repeated for a second cycle, and the Relative Deposition is measured as described below.

Test Wash Detergent Composition

| Ingredient | % (Wt.) |
|---|---|
| $C_{13}$ Linear Alkyl Benzene Sulfonate | 9.0 |
| $C_{14-15}$ Alkyl Sulfate | 9.0 |
| Neodol ® 23-6.5T (Alkyl ethoxylate) (Mfg. by Shell Chem. Co.) | 1.5 |
| Sodium Tripolyphosphate | 38.4 |
| Silicate | 14.6 |
| Sodium Carbonate | 21.3 |
| Water and Miscellaneous | balance to 100 |

B. Relative Deposition Measurement

The deposition of the clay containing compositions is calculated based on the deposition of silicon (Si) of terry cloth swatches washed with the test wash detergent composition relative to terry cloth swatches that were prewashed but not subjected to the test wash procedure (blank swatches). Silicon deposition is determined by measurement of the X-ray fluorescence of the silicon. Each Silicon fluorescence is measured in the following manner: An EDAX 9500 X-ray fluorescence unit with a rhodium anode X-ray source (Philips Electronics, Inc., Cincinnati, Ohio) is used. Each terry cloth swatch is analyzed for 100 live seconds. Count rate of Si (on a per second basis) for each sample is measured and recorded.

Relative Deposition of clay is calculated by the following equation:

$$\text{Relative Desposition} = \frac{STF - SBF}{SW} \times 1000$$

wherein, STF is the Si count rate of clay-treated terry cloth fabric, SFB is the Si count rate of blank terry cloth fabric and SW is the Si count rate of a clay sample wafer (pressed clay particles of same area of terry cloth fabric). Count rates of Si for the clay sample wafer and clay deposition on fabric are measured as follows:

(a) Si count rate for clay sample wafer: The X-ray generator is set at 20 kV/500 microamps. About 2 g of clay powder is pressed at about 20,000 psi into a pellet with a 30 ton hydraulic press (Angstrom, Inc., Chicago, Ill.). The sample is rotated during the count rate analysis in a vacuum atmosphere (less than 300 millitorr).

(b) Si count rate for the terry cloth treated with clay: The X-ray generator parameter is set at 15kV/500 microamps. A disk with a 3 cm diameter is cut from a terry cloth swatch. The disk is compressed at about 20,000 psi to form a flat smooth disk using a ton hydraulic press, then rotated during the count rate analysis in a vacuum atmosphere.

EXAMPLES

The following product formulations exemplify the present invention.

| Ingredient (all wt. percentages) | Example # I | II | III | IV | V |
|---|---|---|---|---|---|
| Bentone EW (NL Industries) | 90% | 67% | 90% | 76.5% | 76.5% |
| Sodium Carbonate | 10% | 33% | — | — | 15.0% |
| Sodium Sulfate | — | — | 10% | 15.0% | — |
| Silica/dye composite | — | — | | 8.5% | 8.5% |

In the formulations above the Bentone EW can be replaced, in whole or part, with Macaloid (NL Industries), IMV Hectorite (Industrial Mineral Ventures), or Turkish Calcium Hectorite Clay, while still providing excellent results.

The compositions can be prepared by agglomerating the clay in a commercial food processor, or other agglomeration equipment known in the art, with a solution of the salt dissolved in deionized water (eg. 15.0 g salt per 30.0 ml water). The salt solution should be slowly added during the agglomeration procedure. The resulting product can be air-dried at ambient temperature.

Optionally, a water-soluble dye can be incorporated into the composition. This can be done, as in Example IV and V, by stirring a carrier, such as formed silica gel particles (e.g. Syloid R 234), with the agglomeration equipment and slowly adding a dye solution (eg. 1.0 gram of F.D. & C Blue #1 per 30 ml of deionized water), at a final dye to silica weight ratio of about 1.0%, until the desired dye level (relative to the total weight of the composition) is obtained. The silica/dye particles can then be agglomerated, preferably with an aqueous salt solution (15.0 g $Na_2SO_4$ in 30.0 ml deionized water), air dried, and admixed with the clay particles.

The agglomerated clay and silica/dye particles are screened with testing sieves known in the art to, separate agglomerates less than 100 microns and greater than 1250 microns.

EXAMPLE VI

This example shows an aqueous dispersion composition of the present invention.

2 g of a natural hectorite clay (*) is added—under vigorous mixing—to 97.5 g of deionized water. High speed mixing is maintained till complete dispersion of the clay. Dyestuff and perfume are added, to make up 100%.

When applied in the rinse step of a laundry program, such a fabric softening composition delivers very significant softness benefits.

EXAMPLE VII

To 93.13 g of deionized water, 2.27 g of a low molecular weight polyacrylate (*) is added under moderate mixing conditions. High speed mixing is then used to optimally disperse 4 g of a natural hectorite clay (**). After dispersing, dyestuff and perfume are added (0.6 g) to finish the composition.

(*) Na - polyacrylate: 44% pure/MW=4500.
(**) Bentone EW as in Example I.

EXAMPLE VIII

30kg of a Bentone EW natural hectorite clay are added to a Loedige agglomerating equipment. Deionized water (+/−5 kg) is sprayed onto the clay powder till agglomeration is reached. The wet agglomerates are dried and sieved to a desired particle size (pref. 100% through 10 mesh and 0% through 100 mesh-Standard Tyler Sieves).

The agglomerates are subsequently dyed and perfumed.

EXAMPLE IX

An intimate mixture of 24 kg of a natural hectorite clay powder (*) and 0.6 kg of PEO clay-flocculating polymer (**) is added to a Loedige agglomerator. A mixture of deionized water (+/−4 kg), glycerol (0.65 kg) and the sodium salt of Ethylenediamine tetramethylene phosphonate (0.6 kg of a 25% solution) is sprayed onto the clay/PEO mixture. Extra deionized water is eventually added to obtain suitable agglomeration. The wet agglomerates are dried, sieved, dyed and perfumed.

(*) Macaloid clay ex Hector CA (NL Chemicals) Sodium form
(**) polymer of ethylene oxide/MW=300,000

In Examples VI to VIII, the hectorite is used in its sodium form. The clay can also be used in its calcium form and converted to its sodium form during agglomeration, as shown in Example X.

EXAMPLE X 20 kg of a natural calcium hectorite clay powder and 0.4 kg of sodium carbonate are well mixed prior to their addition to a Loedige agglomerating equipment. +/−4 kg of deionized water is used for the agglomeration. The wet agglomerates are dried, sieved, dyed and perfumed.

What is claimed is:

1. A granular fabric conditioning composition comprising agglomerates of from about 0.5% to about 40% of a binding/dispersing agent and from about 10% to about 99% of a clay material, said clay material consisting essentially of a hectorite clay of natural origin, said hectorite clay having the general formula:

$$[Mg_{3-x}Li_x)Si_{4-y}Me_y^{III}O_{10}(OH_{2-z}F_z)]^{\frac{-(x+y)}{n}}M^{n+}$$

wherein when $y \neq 0$, $Me^{III}$ is Al, Fe, or B; or y=o; $M^{n+}$ is a monovalent (n=1) or divalent (n=2) metal ion, said clay having a layer charge distribution (x+y) such that at least 50% of the layer charge is in the range of from about 0.23 to about 0.31; wherein said agglomerates have a median diameter of between about 75 microns and about 2000 microns.

2. A granular fabric conditioning composition according to claim 1, wherein said hectorite clay has a distribution of layer charge (x+y) such that at least about 65% of the layer charge is the range of from about 0.23 to about 0.31.

3. A granular fabric conditioning composition according to claim 2, wherein said composition additionally comprises an organic fabric softening ingredient.

4. A granular fabric conditioning composition according to claim 3, wherein said composition additionally comprises a static control agent.

5. A granular fabric conditioning composition according to claim 3, wherein said composition comprises from about 1% to about 10% of an amine of the formula $R_1R_2R_3N$, wherein $R_1$ is selected from $C_6$ to $C_{20}$ hydrocarbyl groups, $R_2$ is selected from $C_1$ to $C_{20}$ hydrocarbyl groups and $R_3$ is selected from $C_1$ to $C_{20}$ hydrocarbyl or hydrogen groups.

6. A granular fabric conditioning composition as in claim wherein said binding/dispersing agent is a water soluble inorganic salt and said agglomeratescomprise from about 1% to about 40% of said inorganic salt.

7. A granular fabric conditioning composition as in claim 2, wherein said binding/dispersing agent is a water soluble inorganic salt and said agglomerates comprise from about 5% to about 40% of said inorganic salt.

8. A granular fabric conditioning agent as in claim 7, wherein said inorganic salt is a sodium salt of a sulfate or a carbonate.

9. A granular fabric conditioning composition according to claim 6, wherein said binding/dispersing agent further comprises a surfactant, and said surfactant comprises from about 0.5% to about 30% of said agglomerates.

10. A granular fabric conditioning composition according to claim 1, wherein, said binding/dispensing agent is a surfactant which comprises from about 0.5% to about 30% of said agglomerates.

11. A granular fabric conditioning composition according to claim 1, wherein the Relative Deposition (77 ppm, wash cycle-added) of the clay is at least about 2.5.

12. A granular fabric conditioning composition according to claim 8, wherein the Relative Deposition of the clay is at least about 2.9.

13. A granular fabric conditioning composition according to claim 12, wherein the Relative Deposition (150 ppm, wash cycle-added) of the clay is at least about 13.0.

14. A granular fabric conditioning composition according to claim 13, wherein when $y \neq 0$ the binding/dispersing aid is a sodium salt of sulfate or carbonate and said agglomerates comprise from about 5% to about 35% of said sodium salt.

15. A fabric-softening composition comprising an aqueous dispersion of a clay ingredient, said clay ingredient consisting essentially of a hectorite clay of natural origin, said hectorite clay having the general formula:

$$[Mg_{3-x}Li_x)Si_{4-y}Me_y^{III}O_{10}(OH_{2-z}F_z)]^{\frac{-(x+y)}{n}}M^{n+}$$

wherein $Me^{III}$ is Al, Fe, or B; or y=o; $M^{n+}$ is a monovalent (n=1) or divalent (n=2) metal ion, said clay having a layer charge distribution (x+y) such that at least 50% of the layer charge is in the range of from 0.23 to 0.31; and said composition further comprises a clay flocculating agent, an organic humectant, an organic fabric softening ingredient, or a static control agent.

16. A composition according to claim 15, wherein said hectorite clay has a distribution of layer charge (x+y) such that at least 65% of the layer charge is in the range of from 0.23 to 0.31.

17. A composition according to claim 15, which is in the form of an aqueous dispersion, containing from 0.5% to 30% by weight of the hectorite clay.

18. A composition according to claim 17, wherein the hectorite clay is present at levels of from 2% to 15% by weight.

19. A composition as in claim 18, wherein said composition comprises from about 0.05% to about 20%, by weight of the clay, of a clay-flocculating agent selected from the group consisting of poly(ethylene oxide), poly(acrylamide), and poly(acrylic acid).

20. A composition as in claim 19, wherein said composition comprises from about 0.1% to about 2%, of an organic humectant selected from the group consisting of glycerol, ethylene glycol, propylene glycol, and dimers and trimers thereof, and mixtures thereof.

21. A granular fabric-softening composition comprising a hectorite clay of natural origin, said hectorite clay having the general formula:

$$[Mg_{3-x}Li_x)Si_{4-y}Me_y^{III}O_{10}(OH_{2-z}F_z)]^{\frac{-(x+y)}{(x+y)}}_{n} M^{n+}$$

wherein $Me^{III}$ is Al, Fe, or B; or y=o; $M^{n+}$ is a monovalent (n=1) or divalent (n=2) metal ion, said clay having a layer charge distribution (x+y) such that at least 50% of the layer charge is in the range o 0.23 to 0.31; and said composition further comprises a flocculating agent, an organic humectant, an organic fabric softening ingredient, or static control agent.

22. A composition according to claim 21, wherein said hectorite clays has a distribution of layer charge (x+y) such that at least 65% of the layer charge is in the range of from 0.23 to 0.31.

23. A composition according to claim 21, which is in the form of an aqueous dispersion, containing from 0.5% to 30% by weight of the hectorite clay.

24. A composition according to claim 23, wherein the hectorite clay is present at levels of from 2% to 15% by weight.

25. A composition as in claim 24, wherein said composition comprises from about 0.05% to about 20%, by weight of the clay, of a clay-flocculating agent selected from the group consisting of poly(ethylene oxide), poly(acrylamide), and poly(acrylic acid).

26. A method for softening fabrics, utilizing a clay softening ingredient, during laundering of such fabrics in aqueous laundry solution, said method comprising agitating said fabrics in said aqueous laundry solution in the presence of at least about 50 ppm of said clay softening ingredient, aqueous laundry solution weight basis said clay being added to either a rinse stage or a wash stage of said laundry solution, wherein the improvement thereof comprises selection of said clay softening ingredient such that it consists essentially of a hectorite clay of natural origin having the general formula:

$$[Mg_{3-x}Li_x)Si_{4-y}Me_y^{III}O_{10}(OH_{2-z}F_z)]^{\frac{-(x+y)}{(x+y)}}_{n} M^{n+}$$

wherein $Me^{III}$ is Al, Fe, or B; or y=o; $M^{n+}$ is a monovalent (n=1) or divalent (n=2) metal ion, said clay having a layer charge distribution (x+y) such that at least 50% of the layer charge is in the range of from 0.23 to 0.31.

* * * * *

UNITED STATES PATENT AND TRADEMARK OFFICE

CERTIFICATE OF CORRECTION

PATENT NO. : 5,062,972

DATED : 10/05/91

INVENTOR(S) : ANDRE' CESAR BAECK, ALFRED BUSCH, YOUNG SIK OH

It is certified that error appears in the above-identified patent and that said Letters Patent is hereby corrected as shown below:

Column 13, line 68, "claim " should read --Claim 1--.

Column 14, line 1, "agglomeratescomprise" should read --agglomerates comprise--.

Signed and Sealed this

Twenty-eighth Day of September, 1993

Bruce Lehman

*Attest:*

BRUCE LEHMAN

*Attesting Officer*

*Commissioner of Patents and Trademarks*